United States Patent [19]

Eigenmann

[11] Patent Number: 4,565,467

[45] Date of Patent: Jan. 21, 1986

[54] METHOD AND APPARATUS FOR THE CONTINUOUS LAYING ROAD MARKING STRIPS ONTO ROADWAY SURFACES

[76] Inventor: Ludwig Eigenmann, POB 114 CH 6833, Vacallo, Switzerland

[21] Appl. No.: 562,404

[22] Filed: Dec. 16, 1983

[30] Foreign Application Priority Data

Dec. 24, 1982 [IT] Italy ..... 24973 A/82

[51] Int. Cl.[4] ..... E01C 23/16

[52] U.S. Cl. ..... 404/72; 404/94

[58] Field of Search ..... 404/72, 93, 94; 118/35, 118/37

[56] References Cited

U.S. PATENT DOCUMENTS

| | | | |
|---|---|---|---|
| 3,964,835 | 6/1976 | Eigenmann | 404/94 |
| 4,030,958 | 6/1977 | Stenemann | 404/94 |
| 4,236,950 | 12/1980 | Eigenmann | 404/93 |

FOREIGN PATENT DOCUMENTS

| | | | |
|---|---|---|---|
| 2602947 | 7/1976 | Fed. Rep. of Germany | 404/94 |
| 378925 | 8/1964 | Switzerland | 404/94 |

*Primary Examiner*—Stephen J. Novosad
*Assistant Examiner*—William P. Neuder
*Attorney, Agent, or Firm*—Michael J. Striker

[57] ABSTRACT

An auxiliary apparatus for mounting on machines is used for the spray application of road-markings and provides the machines with the alternate capability of laying prefabricated road-marking strips. The auxiliary apparatus is externally mounted on one side of the machine, and it enables laying of prefabricated strips onto the roadway surface without the interruption while the machine is moving along, by means of a cutting device and a device which presses the strip firmly onto the roadway surface so as to guarantee freedom from the accumulation of dirt. The apparatus is adapted for laying a very large quantity of strips, by providing for the substitution of the empty reel by a full one, without any interruption in the laying operation.

11 Claims, 11 Drawing Figures

METHOD AND APPARATUS FOR THE CONTINUOUS LAYING ROAD MARKING STRIPS ONTO ROADWAY SURFACES

BACKGROUND OF THE INVENTION

Over the last decades, traffic safety problems, connected with horizontal road-markings, have been rather inadequately solved by the use of either short-lived strips, applied by spraying a solvent-liquified material onto the road surface, or by using a long-lived thermoplastic material applied to the road surface in the liquid state. At a certain point, special machines—which are now in use all over the world—were developed for making the spray application of road-markings rapid. With the advent of the type of road-marking with a long service life, the market slowly began to become saturated. The available machines became insufficiently utilized and the degree of safety on the roads, in connection with horizontal road-markings, became altogether unsatisfactory.

Over a considerable number of years, the Applicant has developed methods and products regarding horizontal road-markings. In particular, and by way of example, the following are cited: Italian Pat. No. 1,022,451 and its corresponding U.S. Pat. No. 4,069,281, Italian Pat. No. 28747 A/76, applied for on Oct. 27, 1976, and its corresponding U.S. Pat. No. 4,236,950.

The products covered by these patents, consisting in horizontal road-marking strips, have numerous advantages over the spray type road-marking, as the high efficiency during many years, efficiency which may be improved for obtaining a better visibility also in rainy weather by means of the application on the strips, also during their manufacturing, of improved retroreflecting elements, which are also covered by numerous inventions of the applicant.

These superior prefabricated strips provide a high degree of road safety; but despite the outstanding results obtained with them, they are not in a very wide use, not only because of their higher cost, but also because of the need of new considerable investments in new laying-down apparatuses, while such investments are quite problematical in the light of the overabundance of conventional machines and the general short supply as concerns the funds available for such investments.

The reason the investment required is rather considerable because of the large volume taken up by the prefabricated-strip reel presently being used.

Italian Pat. No. 22353 A/76, applied for on Apr. 15, 1976, and its corresponding U.S. Pat. No. 4,156,635 cover the Applicant's invention of a new marking strip which is extremely thin, thus satisfying the requirements of low cost and low volume.

SUMMARY OF THE INVENTION

It is an object of the present invention to provide an improved apparatus for the handling and laying of the above-mentioned new marking strip. The apparatus is designed to be mounted, as auxiliary equipment, on the old machines, thus giving the machines the additional capability of laying prefabricated strips. Being mounted on the outer side of the machine, the auxiliary apparatus does not interfere with the operation of the machine itself and permits the continuous laying of the prefabricated strip at the same running speed at which the machine normally operates when applying road-marking by the spray method.

With smaller machines, the thinness of the strip permits the laying down of as much as 1 km of uninterrupted road-marking. With large machines, the auxiliary apparatus permits the rapid laying of uninterrupted strip measuring many kilometers in length. This is made possible due to the special feed design of the apparatus which allows reel substitution without having to stop operations. The preparatory liquid which must be applied to the road surface prior to the laying of the strip is done by the machine itself in coordination with the action of the auxiliary apparatus.

The cam mechanism may be provided on the auxiliary apparatus, which controls the cutting and laying of the strip and which also controls the spraying of the road-surface preparatory liquid at the same time.

DETAILED DESCRIPTION OF THE PREFERRED EMBODIMENTS

Figure 1A:
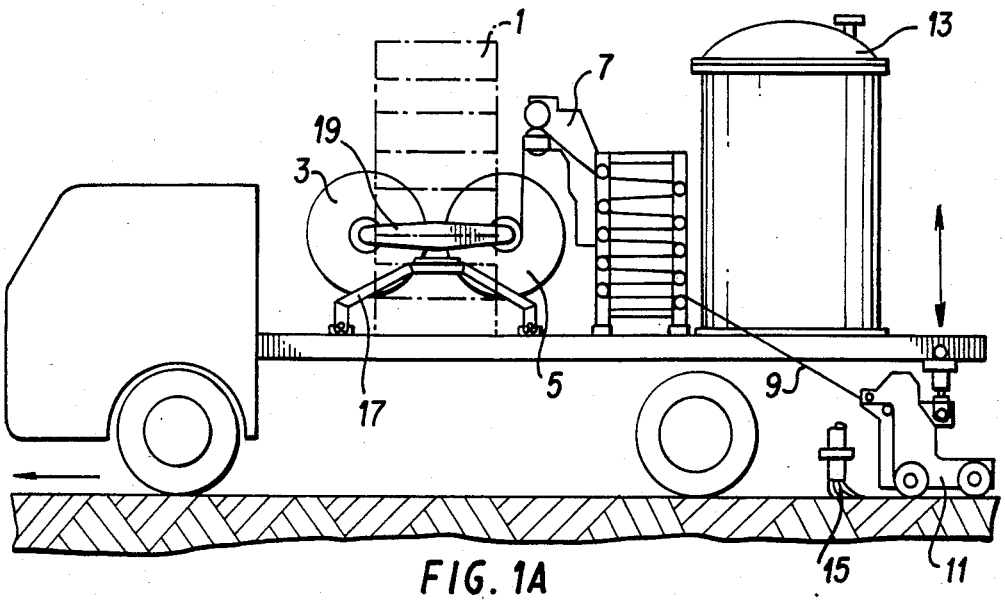
FIG. 1*a* shows a top plan view of the machine of FIG. 1.
Figure 1B:
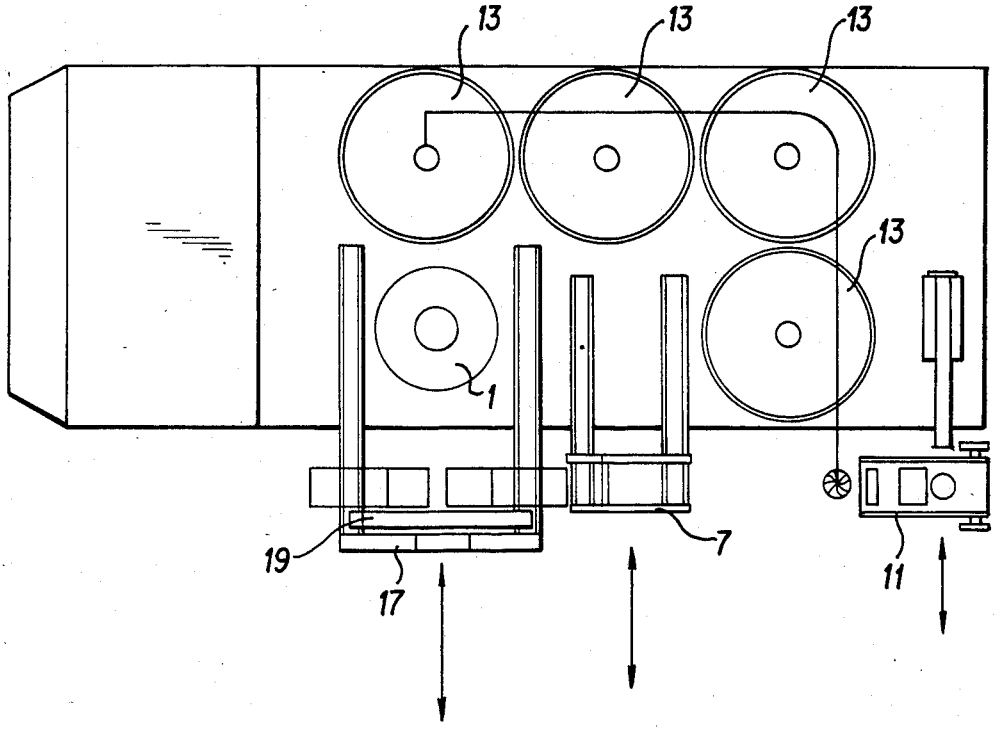
FIG. 1 shows an example of the mounting of the auxiliary apparatus of this invention on a marking-strip machine.

The FIGS. 1 and 1*a* show the apparatus used on a large machine. Instead of just one reel being used, more than one are used, so that when one becomes empty it is replaced by a full one, thus providing uninterrupted strip feeding.

In FIG. 1 reels 3, 5 are shown stacked, waiting to be used, and contain, specifically, road-marking strips, which are hereafter referred to, for brevity, as strip. A support (17), is fitted with a lever arm (19) which holds a reel, at position (5), during the working phase. The next reel waiting to be used is shown at position (3). When the reel at position (5) is used up, the operator joins the remaining end of the reel (5) to the starting end of the next reel (3), using a double-faced adhesive tape. The operator then takes the reel from position (3) and puts it in position (5) and puts a full reel in position (3). Reference numeral (7) denotes an accumulation or compensation system whereby uninterrupted feeding of the laying device is made possible by allowing the operator sufficient time to join the strip ends from the two reels. This system is described in detail below with reference to FIG. 7.

As seen from FIG. 1, the strip (9) extends from the accumulation system 7 to the laying device (11), which is schematically represented.

This laying device can include both the devices for cutting the strip into set lengths—which are described below with reference to FIGS. 2 and 3—and the actual strip-laying devices—which are described below with reference to FIGS. 4, 5 and 6.

The tanks shown by reference (13) are assumed to be already mounted on the machine and normally hold the product used for producing the road-markings in the traditional manner. They are now to be used, however, for holding an adhesive liquid required for spraying (at 15) onto the road surface prior to laying down the strip.

The devices (17), (7), (15) and (11) are shown in the working position, which is on the outside of the machine. Obviously, when the devices (11) and (15) are lifted up by any known appropriate means, the aforenamed devices can be rolled back on the provided rails so as to be contained within the normal overall dimensional limits of the machine.

Figure 2:
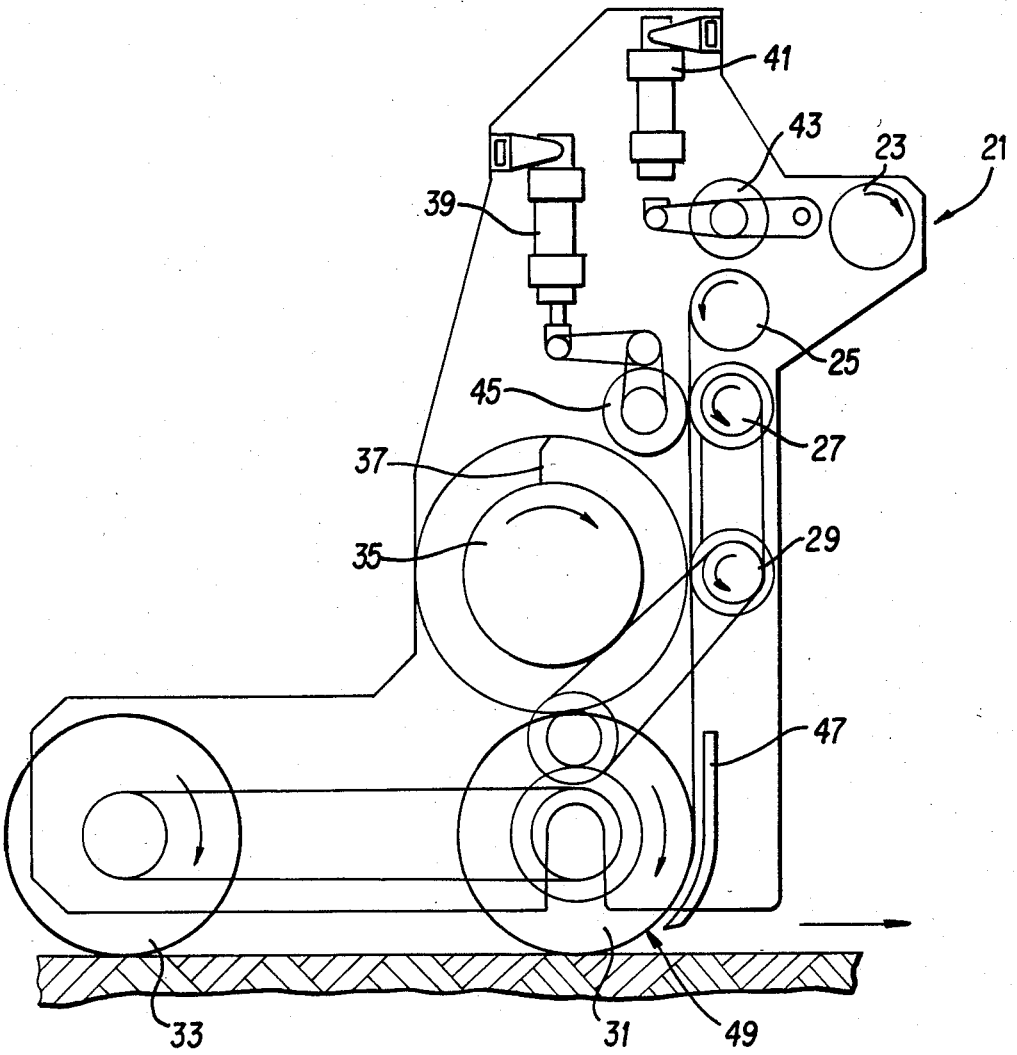
FIG. 2 is a side view of the auxiliary apparatus of this invention.

Getting down to the essence of this application, FIG. 2 shows the auxiliary apparatus which was schematically shown in FIG. 1. The essential components of the apparatus are the strip-cutting device and the device for pressing the lengths of strip onto the road surface.

The strip to be deposited enters at (21) and passes over the rollers (23), (25), (27) and (29). A description of the cutting operation, which takes place at the roller position (29), is described in detail below.

The laying-down of the lengths which have been cut is performed by the roller (31), which is coated with a layer of anti-adhesive silicon rubber.

Support and guidance is provided by the rollers (33).

Through a gear and chain system, roller (31) controls rollers (27) and (29). Roller (31) also controls the cutting roller (35), which holds the cutting blade (37), by means of a clutch-brake unit, and also controls—either directly or through one of the above-mentioned rollers—a cam unit, which is not shown in the drawing.

One of these cams causes the clutch to engage, thus activating the roller (35) which carries the cutting blade (37). The said cam determines the length of strip being cut. The apparatus can be furnished with a series of cams, each with a particular lobe, so that different lengths of strip can be cut, as desired. Another cam, also available in various lobe configurations, controls the stopping of the movement of the strip during the laying-down of the length of strip which has just been cut, in connection with the distance covered by the apparatus, that is the number of turns of the roller (31) corresponding to the desired spacing between the length of one strip and the following one. The piston (41), also actuated by a cam, brings the roller (43) up firmly against the roller (25), thus keeping the strip from being advanced. In connection with the distance which is desired between a length of strip and the following one, the cam causes the movement of the strip to be freed, bringing the piston (41) up in its starting position, and at the same time actuates piston (39), which brings the idler roller (45) up against roller (27), thus permitting roller (27) to engage the strip and advance it again until the completion of the subsequent cutting operation. At this point, roller (43) not only blocks the strip but the cam also causes piston (39) to return to its starting position, thus causing the disengagement of roller (27) and interrupting the advancement of the strip. As shown in the drawing, the guide (47) directs the end of the strip (49) to the lower side of the reel (31). As soon as the desired strip length goes past the cutting point on the roller (29), the whole sequence of operations described above are repeated.

Figure 3A:
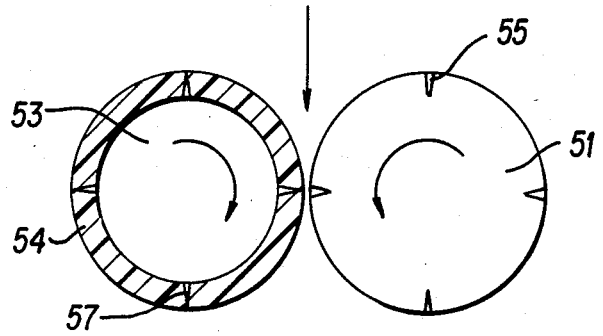
FIGS. 3 and 3*a* illustrate strip-cutting rollers in two different positions, in accordance with a modified embodiment.
Figure 3B:
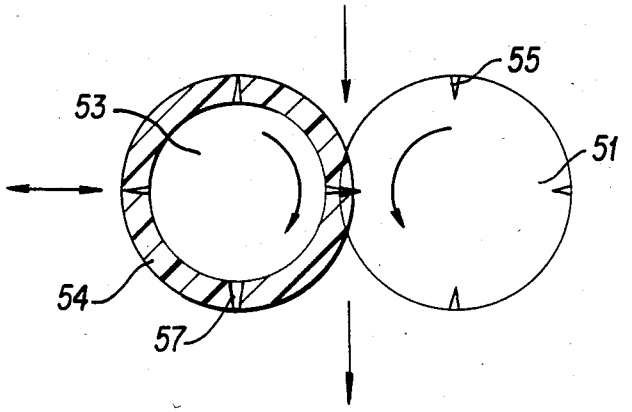

FIG. 3 shows the apparatus slightly modified as compared with that shown in FIG. 2. The modification regards the cutting device and shows two rollers (51) and (53) which turn continuously in the direction shown by the arrows. Being interconnected by gearing, their motion is synchronous with the rotation being controlled by the laying roller (31), FIG. 2, much in the same way as are the rollers comprising the FIG. 2 variant.

The two aforesaid rollers are brought together just enough without causing the strip to be advanced. Advancement occurs only through the action of the laying roller (31), FIG. 2, or by the roller (27), FIG. 2, during the phase following the cutting operation, as described previously and with reference to FIG. 2.

The roller (51) is either made completely of metal or can be made of a synthetic material. The roller has a certain number of indentations (55) on its surface. Four of them are shown in the drawing. Roller (53), on the other hand, can be made entirely of metal or can consist of a metallic portion and a synthetic-material portion in the center. Soft resilient sectors (54)—which can be of rubber or, for example, polyurethane foam—are mounted on roller (53) peripherally. There is a sector (54) for each indentation (55). The cutting blades are mounted, one each between the sectors (54).

When the previously described sequence of operations—which is controlled by the cam unit in the manner described with reference to FIG. 2—reaches the point where the strip cutting operation is to take place, the roller (53) is brought up against roller (51). This action is accomplished by means of a device not shown in the drawing but which is of obvious and standard design. The bringing together of the two rollers causes the rubber to be compressed and one of the blades to be exposed. The blade cuts the strip and lodges in the corresponding indentation (55) in the roller (51). The relative positions of these rollers during the cutting phase are shown in FIG. 3*a*.

When dealing with a thin strip—as is the case in this patent application—best cutting results are obtained when the strip is not completely cut through but still holds together by means of a few remaining small connecting portions. This guarantees positive and certain advancement of the thin strip. Complete strip separation occurs at the cutting line when the laying roller (31) engages the strip and applies thereon a sudden tensile load.

When the cutting is completed, the laying roller (31), FIG. 2, moves the cut length of strip—which is guided by the guides (47–49), FIG. 2—towards the laying position, while the cam unit causes the stopping and restarting of the incoming strip stock, as described with reference to FIG. 2.

Figure 4:
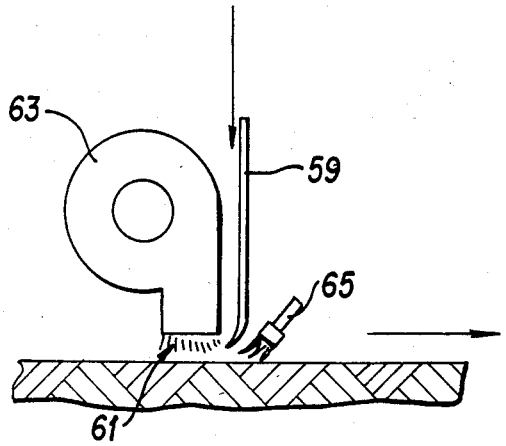
FIGS. 4, 5 and 6 illustrate, respectively, three modified embodiments of the strip-laying device.
Figure 5:
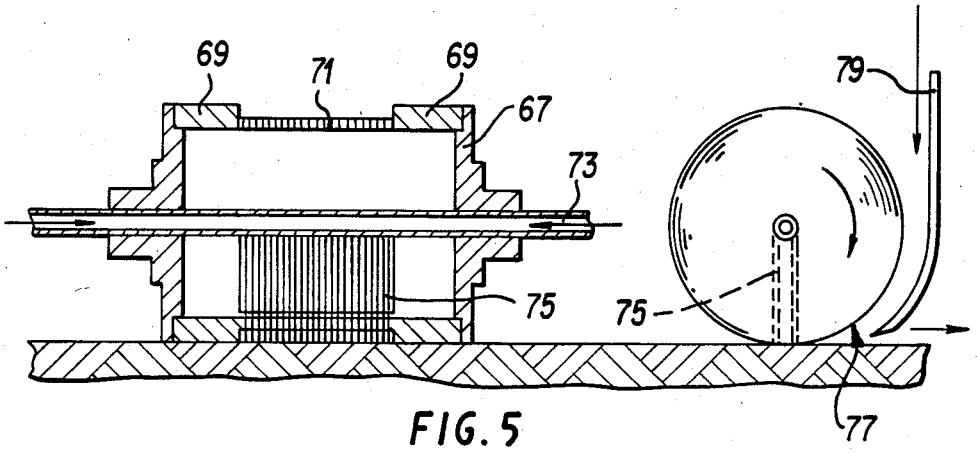
Figure 6:
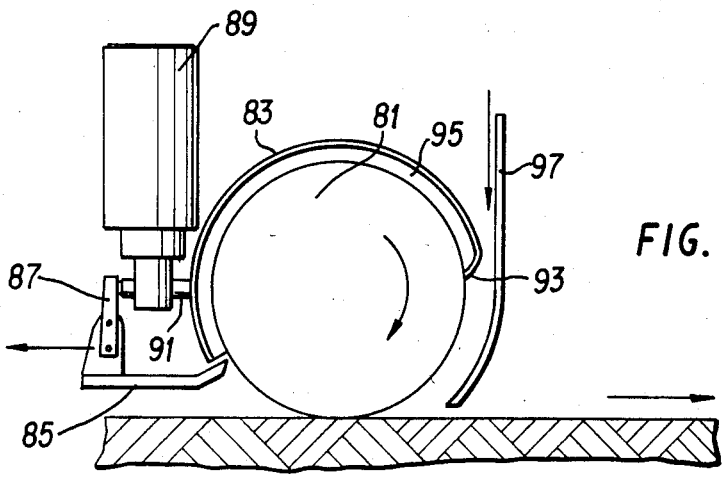

FIGS. 4, 5 and 6 show three variants of the laying device.

These are also part of the object of this invention and are designed to guarantee uninterrupted laying action without having to shut down the apparatus to clean the laying device. This device, consisting of a roller, and the strip being laid in separate lengths end to end with a space between them, makes it impossible to keep the roller from picking up foreign material from the road surface not covered by the strip. Furthermore, the roller also picks up adhesive primer because the length of applied adhesive is greater than that of the strip being laid.

FIG. 4 shows a laying device which uses an air jet instead of a roller. The length of strip to be laid down is guided by a guide (59) under a jet of air (61) generated by a blower (63), obtaining the adhesion of the strip to the road surface, which has been appropriately coated with an adhesive (primer) just prior to the laying operation. An auxiliary air jet (65), which is turned on for only a very short time, could be provided as an alternate. The jet is inclined at an angle so as to assure that the free end of the strip under the jet is securely conveyed.

As a variant, the air jet (61) could be made to operate intermittently, shutting off during the intervals between one strip length and the next. Also, in this case, the control of the jet would be taken care of by the cutting device shown in FIGS. 2 and 3.

FIG. 5 shows a laying roller (67) with a special configuration for high-speed strip-laying operations. The roller is much wider than the strip being laid. The diameter (69) at the outer portions of the roller (67) is proportioned in accordance with the speed of the strip as it is advanced from the cutting device (FIGS. 2 and 3). In the center portion (71), over a distance which approximately equals to the width of the strip being laid, the diameter of the roller (67) is less, and the roller consists of a metal screen, perforated sheet metal or a similar construction. The roller axle (73) consists of a tube which is under internal air pressure. This tube receives air pressure from the conduit (75), which consists of two rectangular units and conducts the air, under pressure, downwards towards the laying zone (77) and through the holes in the center portion (71) of the laying roller (67).

The guide (79) conveys the strip length to the laying zone (77). As a variant, an auxiliary and supplementary air jet—not shown in the drawing but similar to the one previously mentioned with reference to FIG. 4—could be used to simplify the insertion of the starting end of the strip length under the jet coming from the conduit (75).

Also, in this case, appropriate automation, controlled by the already described cam unit, operating in connection with the cutting devices shown in FIGS. 2 and 3, limits the length of time required for the supplementary jet to be turned on. FIG. 6 shows a strip-laying roller fitted with a cleaning device. The cleaning device removes the dust and adhesive primer picked up by the roller, as described previously. This type of roller is also suited for laying road-marking strip at high speeds.

The roller (81) itself is usually made of rubber and most of its periphery is enclosed in a housing (83) which provides sufficient sealing to guarantee good results from the hereunder described cleaning operations.

A blade (85), or scraping unit, scrapes against the roller (81) removing the better part of the accumulated foreign material. When one of the devices described previously conducts the strip length to the roller (81), the water tank (89)—which is pressurized by means of a gas, such as, for example, freon—releases water through the action of an automatic control device (87). The water is squirted out, in a fine spray, out of the nozzle (91). This wets the roller (81) and causes a detaching action on any foreign material and/or adhesive primer which contacts the roller. Another blade (93), or scraper unit, is mainly provided to close off the space around the roller so as to guarantee proper sealing. The housing (83) is designed for easy removal so as to be able to clean out any accumulation of foreign material in the chamber (95). The guide (97), which conducts the strip length under the roller, completes this device. An air jet, not shown in the drawing, may be used as a supplement, if desired. The jet only needs to be turned on for very short periods and is controlled by an automatic device, as for the roller referenced in FIG. 5.

In the case of large machines, which can lay strip over long distances, more than one reel is used, using a system whereby continuous feeding is obtained, with a full reel replacing the empty reel at the right moment.

Figure 7:
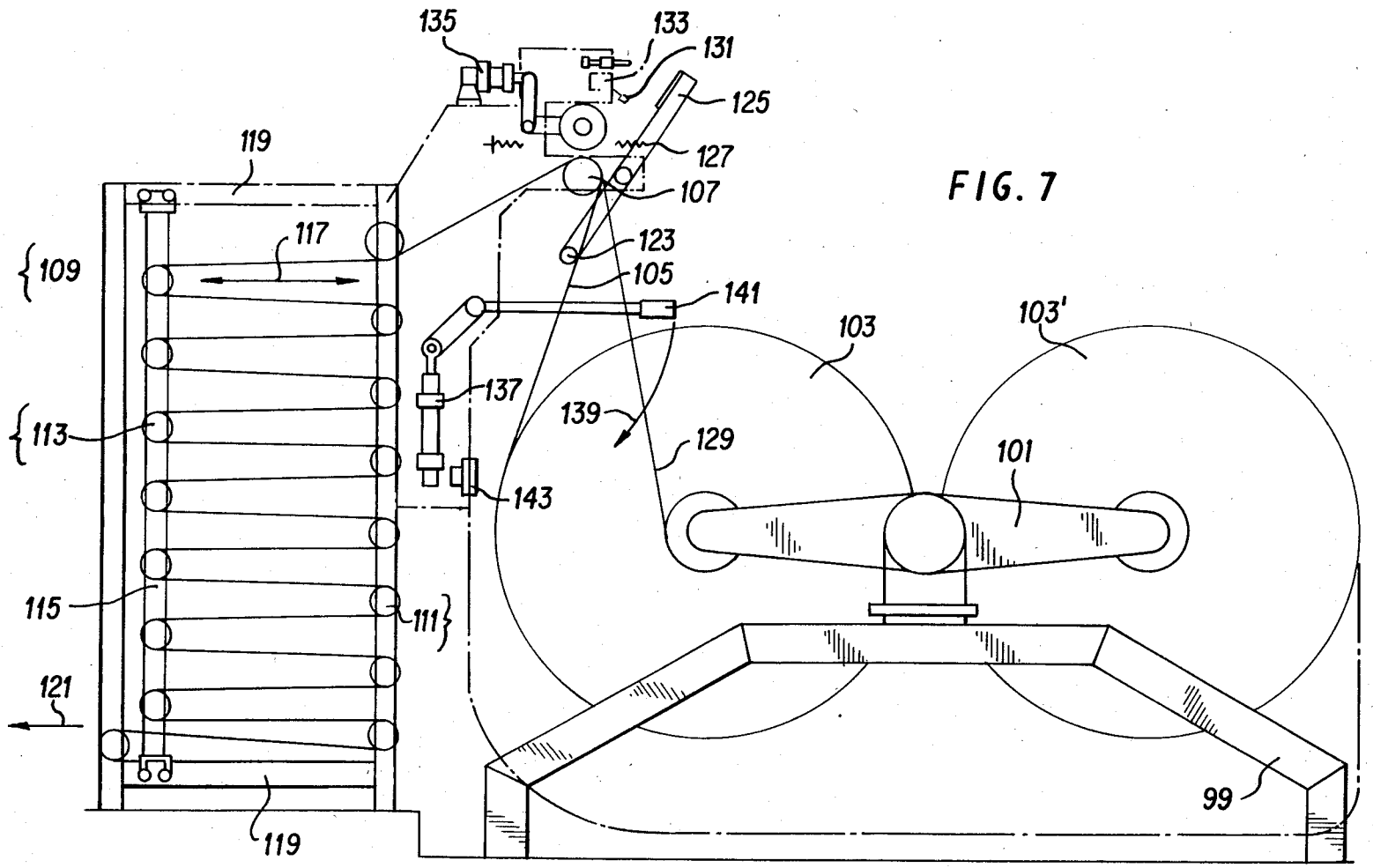
FIG. 7 is a schematic view of a reel-replacement system.

FIG. 7 illustrates this continuous-action, reel-replacement system. It consists of a support (99) to which a lever arm (101), carrying two reels of strip stock, is pinned. The reels are referenced, respectively, (103) and (103').

Reel (103) is shown in the working position, while reel (103') is shown in the stand-by position, ready to take the place of reel (103) as soon as this reel empties.

The strip stock (105) unwinds from reel (103) and goes onto the roller (107), passing, then, to the compensation, or accumulation, system (109). The compensation system (109) consists of set of fixed rollers (111) and a set of movable rollers (113). The movable rollers (113) are mounted on a support (115) which rides on the rails (119) and permits tarnslation in the two directions indicated by the arrows (117). The system's operation is described hereunder.

The strip stock is fed off the reel (103), coming out at point (121), and goes to the strip-laying device.

The reel-replacement and strip-splicing operations are carried out as follows.

First of all, while reel (103) is still unwinding, the operator lays the free end of the strip from reel (103') onto the nozzle (143). A vacuum is made in the nozzle (143), using known means. The operator then applies a strip of double-surfaced adhesive tape to the strip end.

During the working phase, roller (123)—which is connected to the end of the lever (125)—is held constantly against the strip (105) by the spring (127). The roller (123) follows the moving position of the strip until position (129) is reached.

Meanwhile, the upper end of the lever (123) comes closer to—but does not touch—the small lever (131), the latter designed to actuate the microvalve (133).

When the reel is completely unwound; that is, when the end of the strip arrives at position (129), the strip comes free of the reel, losing tension. The spring (127), then, causes the lever (125) to rotate. The small lever (131) is, therefore, actuated, thus starting off the sequence of phases controlled by the microvalve (133).

First of all, the small lever (131) causes the piston (135) to be actuated, which locks the end portion of the strip. The strip, however, continues towards the strip-laying device, thanks to the afore-mentioned accumulation system.

At the same time, piston (137)—which is also pneumatically actuated by standard, known means—causes the plate (141) to move in the direction indicated by the arrow. This causes the free end of the strip to adher to the double-surfaced adhesive tape that was positioned in the manner previously described.

At this point, a device, which is not shown but which is of a standard, known design, causes the reel-carrying arm (101) to rotate about the pin (102), causing the stand-by reel (103') to be brought into the working position.

The operation of the accumulation, or compensation system (109) should now be clear. During the sequence of operations just described, the depositing of the strip leaving the system at point (121) is not interrupted, because the strip stored in the system is utilized, since the unit consisting of the movable rollers (113) moves to the right, as shown in the drawing, towards the unit consisting of the fixed rollers (111). As soon as the strip ends from the two above-mentioned reels have been joined together and the plate (141) has automatically been returned to its starting position, the strip is again free to move. The tension applied to the strip by the strip-laying device detaches the joined strip ends from the nozzle (143). As an alternative, another automatic means can be provided for briefly interrupting the vacuum in the nozzle (143).

The movable rollers (113) are gradually returned to their starting position by means of a standard, known means which is not shown in the drawing. During this phase, of course, the unwinding speed of the strip is greater than the laying speed of the strip lengths. The operational sequence is completed by the operator putting a fresh, full reel on the freed end of the lever arm (101).

Figure 8A:
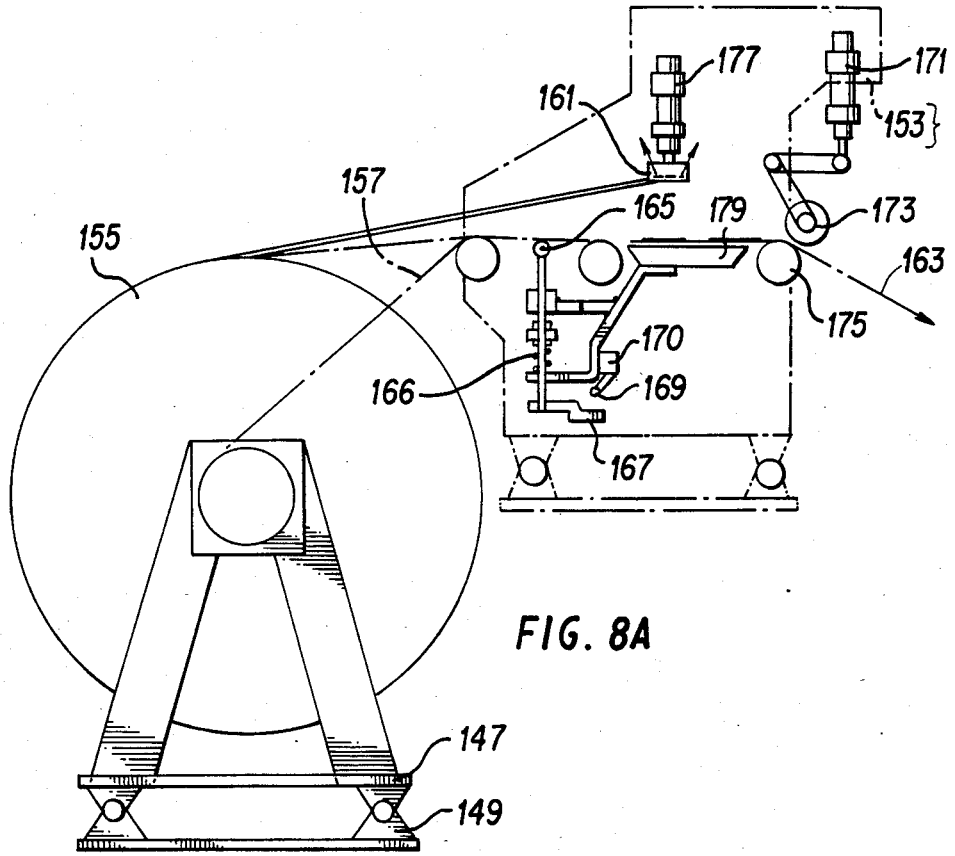
FIG. 8 is a schematic view of a modified embodiment of the reel-replacement system.
Figure 8B:
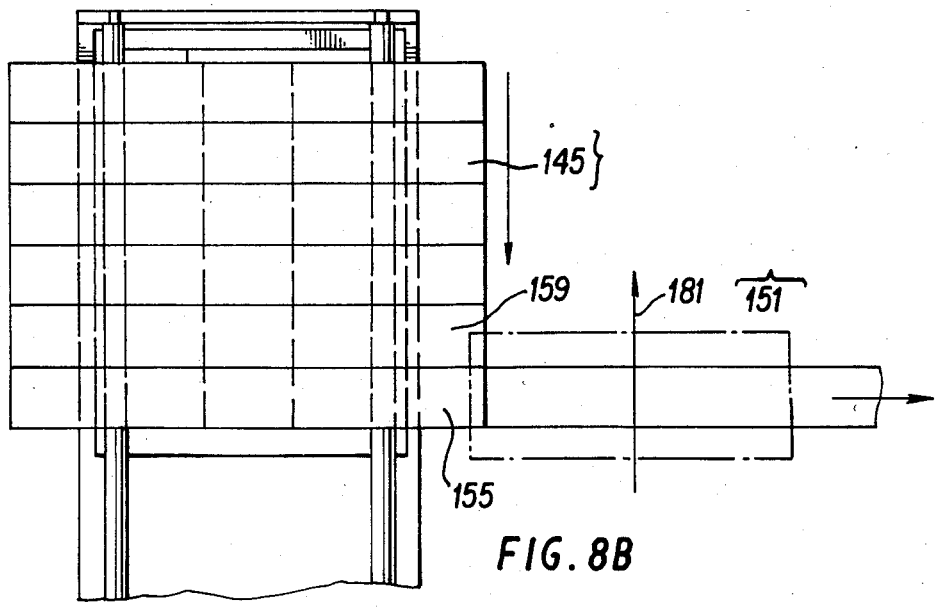

The apparatus shown in FIG. 8 is also part of the object of this invention and constitutes a variant of it. It provides for the replacement of the empty reel with a full one without having to interrupt the strip-laying operations.

An appropriate number of reels (145)—six being shown in the drawing, as an example—are located on a movable support (147).

The support (147) rides on rails (149). The unit referenced at (151) in the plan view and (153) in the side view is a fixed unit. The operation, whereby an empty reel is replaced by a full one and the two ends of the strip stock are joined together, is described hereunder.

While reel (155) is in the working position and the strip being unwound from it is being drawn, at (163), by the laying device, the strip moves towards position (157), shown in the drawing. The operator takes the free end of the strip wound on reel (159) and places it onto the nozzle (161), which has a depression or indentation made in it by a standard, known means. The operator then applies a piece of double-surfaced adhesive tape onto the said strip end. When the reel (155) completely empties, the feeler roller (165)—which is pressed by the spring (166)—goes beyond the level at which, up to this moment, the strip has been travelling. As seen in the drawing, this action brings the plate (167) against the small lever (169), which activates the pneumatic microvalve (170), thus starting off the following sequence of actions.

Piston (171) brings the fixed roller (173) up against the movable roller (175), thus blocking strip movement. At the same time, piston (177) brings the nozzle (161)—which has the strip end from reel (159) adhered to it by means of the double-surfaced adhesive tape, as previously described—against the plate (179), which has the nonmoving end of the strip that has unwound off the reel (155). The strip ends from the two said reels are then joined together.

The sequence of action that is controlled by the microvalve (169) then causes the pistons (171) and (177) to return to their starting positions. The backing off of the fixed roller (173) and the movable rooler (175), therefore, frees the strip, and the tension put on the strip by the strip-laying device and by the accumulation system—which will be described later—causes the joined strip ends to pull free from the vacuum on nozzle (161).

The tension in the strip due to the pulling causes a pressure against the roller (165), which causes the roller (165) to return to its normal position; the one shown in the drawing. Even in this variant case, a sequence phase can be provided whereby the vacuum in the nozzle (161) can be removed for a short period of time, so as to facilitate the detachment of the joined strip ends from it.

When the sequence of action just described has been completed, a standard device—which is also actuated as a result of the tripping of the pneumatic microvalve (177)—causes the reel-carrying support to advance one position in the direction indicated by the arrow (181). This causes the strip, which is unwinding from the reel (159), to be centered with respect to the unit (151).

When all the reels (155) have been used up, the laying operations are suspended while a fresh load of wound reels are placed on the support (147).

The apparatus also has an accumulation system which is identical to that described earlier and referenced to FIG. 7 and which has the same function.

Figure 9A:
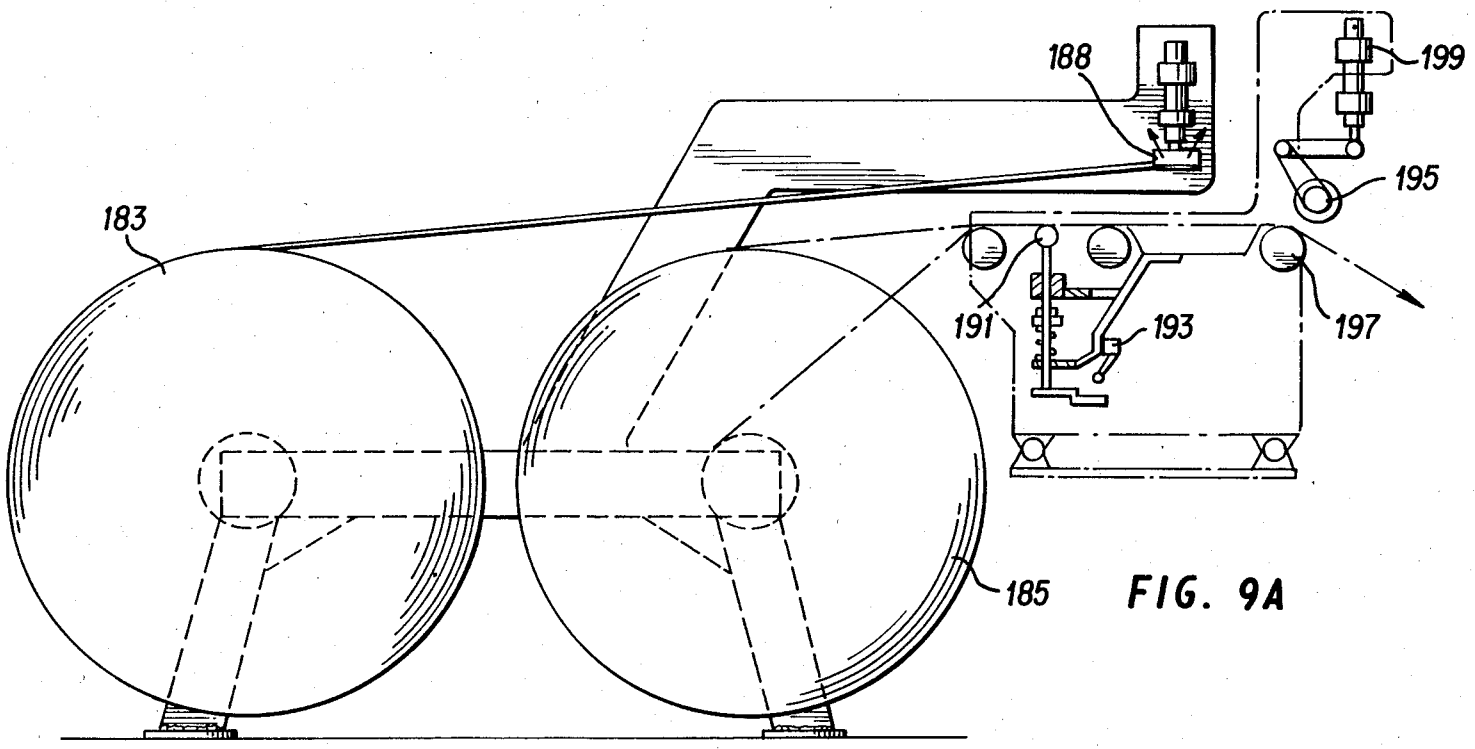
FIG. 9 is a schematic view of yet another embodiment of the reel-replacement system.
Figure 9B:
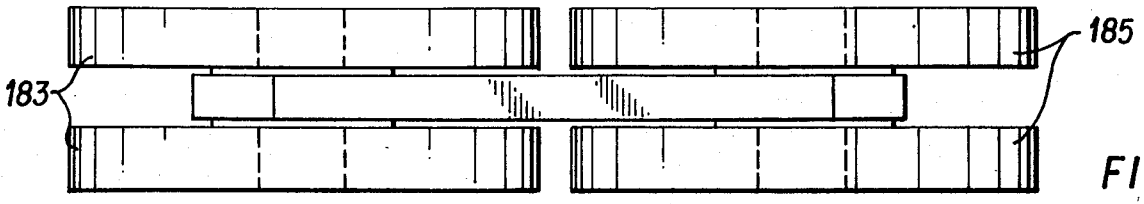

FIG. 9 shows another variant of the apparatus which is also part of the object of this invention. This variant permits the replacement of an unwound reel with a fresh, fully-wound one, without interrupting the strip-laying operations. Reels (183), (184), (185) and (186) are located on a fixed support (187). The unit (189) is identical to that referenced as (151) and (153) in FIG. 8.

The operational sequence is analogous to that described previously with reference to FIG. 8.

Reel (185) is shown in the working position and reel (183) is shown in the stand-by position, ready to replace reel (185). The operator takes the free end of the strip from reel (183) and places it on the nozzle (188), in which a vacuum is made. The operator then attaches a double-surfaced piece of adhesive tape to the strip end, as done in the previously described cases.

When reel (185) becomes completely unwound, the same series of actions take place that were previously described with reference to FIG. 8. In other words, the roller (191) moves suddenly upwards, causing the microvalve (193) to be actuated, followed by the blocking of the strip's movement by roller (195) being pressed against roller (197) by the piston (199), the lowering of the nozzle (188) to which the taped end, with double-surfaced adhesive tape, of the starting strip from reel (183) is stuck, against the finishing strip from reel (185), and then the returning of both the nozzle (183) and the roller (195) to their starting positions.

Another sequence action takes place when, with every two position movements of the roller (191) in the upward direction, a standard, known memory unit causes the unit (189) to move to the position occupied by reels (184) and (186).

At this point the operator attaches to the nozzle (188) the free end of the strip from reel (184), which will join to the strip end from reel (183). When reel (184) is completely unwound, its strip end will be connected to the starting end of the strip wound on reel (186), and so on, since the operator will have taken care of the installation of two full reels in the position formerly occupied by reels (183) and (185). After two more position movements of the roller (191), the unit (189) is automatically brought to the reel (183) and (185) position.

The automatic removal of the vacuum made in the nozzle (183) for facilitating the detachment of the joined strip ends, can also be provided for in this variant. An accumulation system, as previously described, is also necessary.

Inasmuch as all the aforegoing descriptions and illustrations have been submitted by way of representing examples which are not intended to be in any way restrictive, it must be understood that further variants and/or modifications to what has been described are, of course, possible. In any case, however, the full concept of this invention, rather than being limited by the aforesaid descriptions, extends more amply to include the equivalents as defined in any one or more of the following claims.

I claim:

1. An auxiliary, or supplemental, apparatus for mounting onto the type of machine which applies markings to road surfaces using the spray method, designed to provide the said machines with the additional capability of being able to lay prefabricated, road-marking strips, characterized by the fact that the said apparatus is mounted onto the outer side of the road-marking machine and that it guarantees uninterrupted laying of prefabricated road-marking strip at running velocity, by means of the use of a device cutting from a reel, and a means for pressing the strip to the road surface avoiding the accumulation of dirt which could compromise the efficiency of the signaletic capacity, and that both devices are controlled by a cam which also contemporaneously controls the action of the spray device of the machine itself which applies the pretreatment liquid to the road surface receiving the length of the prefabricated road marking strip.

2. An apparatus, as per claim 1, characterized by the fact that the cutting is done by means of one or more cutting blades mounted on a roller, which is moved by means of a clutch in synchronization with the movement of the strip.

3. An apparatus, as per claim 2, characterized by the fact that the cut is not a complete one, which allows separation at the cut line to occur when sudden tension is applied to the strip by the laying roller.

4. An apparatus, as per claim 1, characterized by the fact that the device which presses the strip against the road surface consists of an aimed air jet.

5. An apparatus as per claim 1, characterized by the fact that the device which presses the strip against the road surface consists of a roller, the width of which is greater than the strip itself and which has a central portion with a smaller diameter and is made of a screen-type material that allows air to be blown through it for performing the strip pressing action.

6. An apparatus, as per claim 1, characterized by the fact that the device which presses the strip against the road surface consists of a self-cleaning roller, incorporating at least one scraper and a spraying means, whereby atomized liquid bathes the roller to keep foreign material from sticking to it.

7. An apparatus, as per claim 1, further comprising means for the replacement of an empty reel of road-marking strip with a full reel, without any interruption in the strip-laying operation, so as to lay a considerable quantity of prefabricated strips in a continuous fashion; and a supplementary compensation system, wherein the operation of replacing the empty reel with a full reel take place while a strip end from the full reel is coming closer to the strip end from the empty reel, and wherein two strip ends are then joined together while the supplementary compensation system ensures a non-interruption of the feeding of the strip to the cutting device.

8. An apparatus, as per claim 1, further comprising means for the replacement of an empty reel of road-marking strip with a full reel, without any interruption in the strip-laying operation so as to lay a considerable quantity of prefabricated strips in a continuous fashion, said replacement means including means for bringing together an end of the empty reel to a starting of the full reel.

9. An apparatus as per claim 8, said replacement means further including means for moving the full reel towards a point where the strip ends are joined together, and means for controlling said bringing means.

10. An apparatus as per claim 8, said replacement means further including means for moving a point where the strip ends are joined together towards said full reel which is fixed, and control means for controlling said bringing means.

11. A method for continuous laying road marking strips onto roadway surfaces by an auxiliary apparatus mounted on an outer side of the road-marking machine, comprising the steps of cutting a strip from a reel, pressing the strip to the road surface avoiding the accumulation of dirt which could compromise the efficiency of the signaletic capacity, and controlling the cutting and pressing steps by a cam which also contemporaneously controls the action of a spray device of the machine itself which applies a pretreatment liquid to the road surface receiving the length of prefabricated road marking strip.

* * * * *

UNITED STATES PATENT AND TRADEMARK OFFICE

CERTIFICATE OF CORRECTION

PATENT NO. : 4 565 467

DATED : January 21,1986

INVENTOR(S) : Ludwig Eigenmann

It is certified that error appears in the above—identified patent and that said Letters Patent is hereby corrected as shown below:

In the Claims:

Col. 10, line 24: after "starting" insert --end--

Signed and Sealed this

*Fifth* Day of *August 1986*

[SEAL]

*Attest:*

DONALD J. QUIGG

*Attesting Officer*

*Commissioner of Patents and Trademarks*